US005148725A

United States Patent [19]

Botha

[11] Patent Number: 5,148,725

[45] Date of Patent: Sep. 22, 1992

[54] RATCHET ACTION OPEN ENDED SPANNER

[76] Inventor: Jeremia J. Botha, 1363 Daniel Street, Mountain View, Pretoria, Transvaal, South Africa

[21] Appl. No.: 701,774

[22] Filed: May 17, 1991

[51] Int. Cl.[5] ..... B25B 13/08; B25B 13/10; B25B 13/18; B25B 13/28

[52] U.S. Cl. ..... 81/91.2; 81/92; 81/91.1; 81/91.3

[58] Field of Search ..... 81/91.1, 91.2, 91.3, 81/92, 111

[56] References Cited

U.S. PATENT DOCUMENTS

| | | | |
|---|---|---|---|
| 592,036 | 10/1897 | Woods . | |
| 613,573 | 11/1899 | Jacoby . | |
| 813,892 | 2/1906 | Hielscher et al. . | |
| 1,004,353 | 9/1911 | Bosley . | |
| 1,183,371 | 5/1916 | Ginsburg . | |
| 1,204,383 | 11/1916 | Spanier . | |
| 1,365,784 | 1/1921 | Husson | 81/92 |
| 1,718,719 | 6/1929 | Turner . | |
| 2,441,144 | 5/1948 | Gregory | 81/91 |
| 2,537,838 | 1/1951 | Logan | 81/91 |
| 2,606,805 | 9/1952 | Dyck | 81/91 B |
| 2,618,996 | 11/1952 | Logan | 81/111 |
| 3,044,335 | 7/1962 | Keranen | 81/91 |
| 4,348,921 | 9/1982 | White | 81/91.1 |
| 4,584,913 | 4/1986 | Logan | 81/91.2 |
| 5,050,464 | 9/1991 | Hurtig | 81/91.3 |

FOREIGN PATENT DOCUMENTS

| | | | |
|---|---|---|---|
| 7397 | 12/1910 | France | 81/91.2 |
| 620814 | 3/1949 | United Kingdom | 81/91.2 |

*Primary Examiner*—Frank T. Yost
*Assistant Examiner*—Paul M. Heyrana, Sr.
*Attorney, Agent, or Firm*—Michael, Best & Friedrich

[57] ABSTRACT

A spanner which comprises a handle and jaws, the jaws comprising an upper jaw and a lower jaw, the upper jaw being articulated by means of an upper hinge pin to a distal part of the handle and the lower jaw being articulated by means of a lower hinge pin to the upper jaw, the lower jaw extended by a pawl projecting on the opposite side of the lower hinge pin to the lower jaw, the handle comprising a ratchet tooth which engages with the pawl, in which the upper hinge pin is located near the distal end of the handle and the ratchet tooth is located at an intermediate position between the upper hinge pin and the proximal part of the handle, and in which the ratchet tooth comprises a ramp and a stop, adapted so that rotation of the handle counterclockwise with respect to the upper jaw causes the pawl to ride up the ramp thus closing the jaws until the pawl engages the stop which positively stops further closing of the jaws at a predetermined gap.

5 Claims, 2 Drawing Sheets

Fig. 3
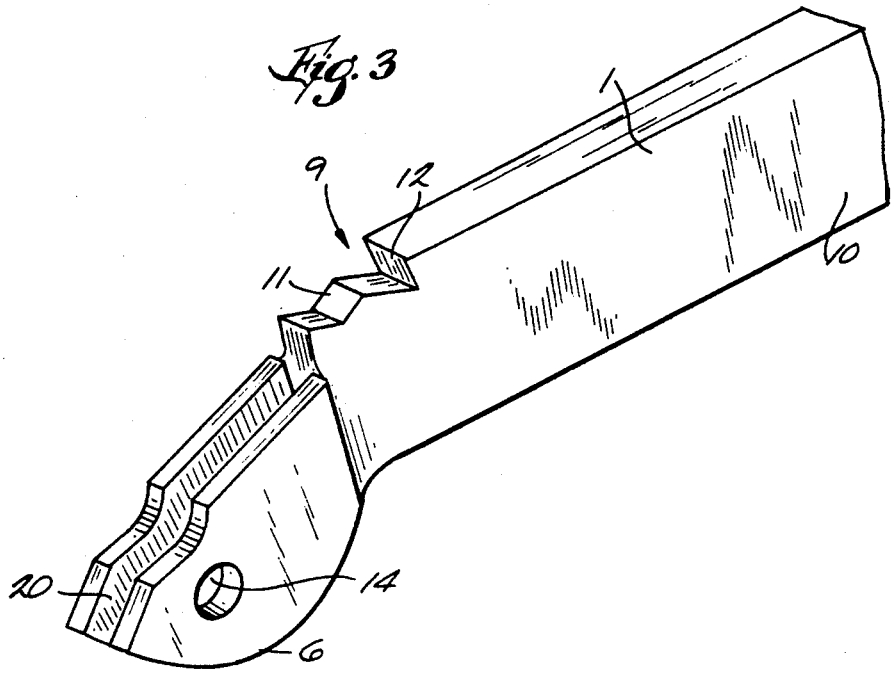
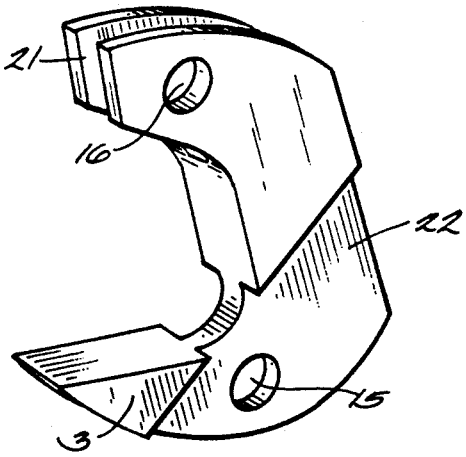
Fig. 4
Fig. 5
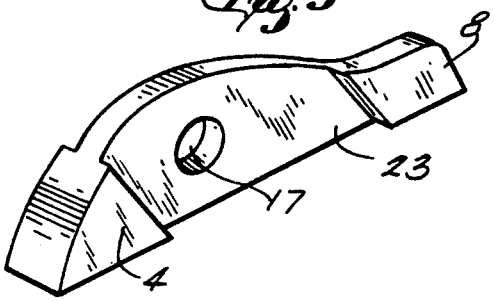

RATCHET ACTION OPEN ENDED SPANNER

BACKGROUND TO THE INVENTION

1. Field of the Invention

This invention lies in the field of ratchet action open ended spanners for use in tightening and loosening bolt heads and nuts, for example, hexagon bolt heads and nuts.

This invention is to be distinguished from implements which have a clamping action designed so that increasing effort applied to the handle of the implement causes increasingly tight clamping pressure in the jaws of the implement. This invention relates to ratchet action open ended spanners whose jaws can move from an open position to being locked in a closed position without exerting a clamping pressure on a bolt head or nut. The invention is thus not applicable to the turning of pipes or similar round objects but only to the turning of bolt heads and nuts.

2. Description of the Prior Art

Oil well tongs or wrenches can be perceived to have a structural resemblance to spanners of the type according to the present invention but the resemblance is superficial because these tongs or wrenches are so designed for the interaction of the handle, upper jaw and lower jaw to cause pressure on the handle to be transferred to a clamping pressure in the jaws. Thus, for example, "Oil well tongs or wrench" are described by J. S. Turner in U.S. Pat. No. 1,718,719 where the handle is pivoted on an upper jaw and a lower jaw is pivoted on the upper jaw, the handle having a nose extension beyond its pivot point which acts as a lever so that pressure on the handle transfers leverage to create a clamping pressure in between the jaw.

Similarly a "Wrench provided with cam actuated self tightening jaws" is described by R. L. Gregory in U.S. Pat. No. 2,441,144 where again a handle is pivoted to an upper jaw and a lower jaw is pivoted to the upper jaw but here the lower jaw has an extended heel extending away from the jaws to interact with a cam or lobe of the handle and the action is again such that increasing pressure on the handle is translated into increasing clamping pressure of the jaw.

Even the "non-slip ratcheting wrench having double hexagon spaced jaw face grooves" described by G. T. Logan in U.S. Pat. No. 2,618,996 although specifically described with reference to acting on a bolt head or nut has a structure which has the same action as the oil well tongs or wrench of J. S. Turner.

The "Open end ratcheting wrench" described by G. T. Logan in U.S. Pat. No. 2,537,838 also has jaws with indentations for a hexagon head bolt or nut but has an opposite action to the wrench in U.S. Pat. No. 2,618,996 in the sense that the nose extension of the handle opens the jaws rather than closing them. However, also U.S. Pat. No. 2,537,838 transfers increasing pressure on the handle to increase clamping force in the jaws.

By contrast the "Movable jaw wrench" described by A. A. Keranon in U.S. Pat. No. 3,044,335 has a mechanism which, according to the direction in which the handle is moved alternately locks the jaws in the position to fit the bolt head or nut or releases the jaws to open. In Keranon the upper jaw has a heel which projects in the opposite direction to the jaws from the hinge pin by which it is hinged to the handle and the opening or closing of the lower jaw with respect to the upper jaw is controlled by complex sliding surfaces and a movable segment.

Also the "Ratchet action open end wrenches" described by L. R. Dyck in U.S. Pat. No. 3,606,805 which also has an upper jaw pivoted to the handle and a lower jaw pivoted to the upper jaw has an arrangement where a lower jaw insert reacts with a nose portion of the handle which extends beyond the hinge pin connecting the upper jaw to the handle towards the jaw area to create a quasi lower jaw. This construction again does not convert pressure on the wrench handle into a clamping action at the jaws but merely provides for the alternate opening and closing of the jaws.

A further disadvantage of all of these designs, save for Gregory, is that it is deemed necessary to provide a spring which acts to tend to open the jaws which lessens the robustness and simplicity of the structure and thus reduces it reliability especially for long and heavy work in arduous conditions.

SUMMARY OF THE INVENTION

It is an object of this invention to provide a ratchet action open ended spanner which has the action merely of either opening the jaws or of closing them to a pre-set configuration without transferring any clamping pressure to the jaws by action on the handle but which nevertheless has a projection of the lower jaw extending away from the hinge pin of the lower jaw in the opposite direction to the jaws and thus inter-acting with the handle of the spanner in a simple, robust and positive way.

It is a further object of the structure that the provision of springs is not required for the satisfactory operation of the ratchet action spanner.

It is a further object that with the absence of the clamping action at the jaws in their closed position these can be slid on or off a bolt head or nut in a convenient manner akin to an ordinary spanner.

It is a specific object of the invention thus to provide an extension of the lower jaw extending to the opposite side of the lower jaw hinge pin to the jaws acting as a pole which interacts with a ratchet tooth in the handle having a ramp and a stop so as to provide robust simple action but at the same time obviating a need for a spring and the stop preventing the exertion of a clamping force at the jaws when pressure is applied to the handle in the direction which closes the jaw.

Thus a spanner in accordance with this invention comprises a handle and jaws, the jaws comprising an upper jaw and a lower jaw, the upper jaw being articulated by means of an upper hinge pin to a distal part of the handle and the lower jaw being articulated by means of a lower hinge pin to the upper jaw, the lower jaw extended by a pawl projecting on the opposite side of the lower hinge pin to the lower jaw, the handle comprising a ratchet tooth which engages with the pawl, in which the upper hinge pin is located near the distal end of the handle and the ratchet tooth is located at an intermediate position between the upper hinge pin and the proximal part of the handle, and in which the ratchet tooth comprises a ramp and a stop, adapted so that rotation of the handle counter-clockwise with respect to the upper jaw causes the pawl to ride up the ramp thus closing the jaws until the pawl engages the stop which positively stops further closing of the jaws at a predetermined gap.

In this specification the terms "upper" and "lower" are interchangable and the term "counter-clockwise"

with "clockwise" according to the orientation, of course, in which the spanner is looked at.

BRIEF DESCRIPTION OF THE DRAWINGS

The invention is more fully described by way an example with reference to the accompanying drawings in which:

FIG. 3 is an isometric view of the handle of the spanner, FIG. 4 is an isometric view of the upper jaws of the spanner, and FIG. 5 is an isometric view of the lower jaws of the spanner.

Figure 1:
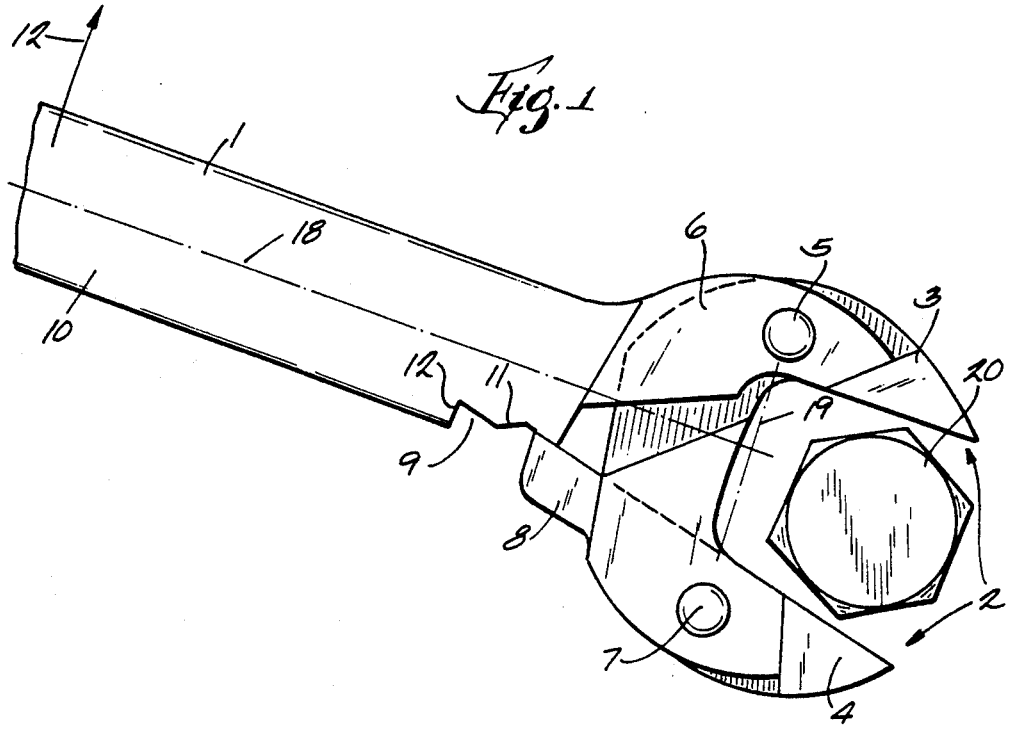
FIG. 1 is a view of the spanner with the jaws in an open position around a hexagon bolt head or nut.

As shown in the drawings the ratchet action open ended spanner comprises a handle 1 and jaws 2, the jaws comprising an upper jaw 3 and a lower jaw 4. The upper jaw 3 is articulated by means of an upper hinge pin 5 to a distal part 6 of the handle 1 and the lower jaw 4 is articulated to the upper jaw 3 by means of a lower hinge pin 7. The lower jaw 4 is extended integrally by means of a pawl 8 projecting on the opposite side of the lower hinge pin 7 to the lower jaw 4 thus projecting in the direction away from the jaws 2. The handle 1 comprises a ratchet tooth 9 which engages with the pawl 8. It is a feature of the design that the upper hinge pin 5 is located near the distal end 6 of the handle 1 and the ratchet tooth 9 is located at the position intermediate between the upper hinge pin 5 and the proximal part 10 of the handle. Furthermore the ratchet tooth 9 has distinctive features comprising the ramp 11 and the stop 12.

The action achieved by this design is that when the handle 1 is rotated in the direction indicated by the arrow 12 in FIG. 1 (clockwise in this view although counter-clockwise if viewed from the other side of the spanner) this rotation of the handle 1 with respect to the upper jaw 3 allows the pawl 8 to ride down the ramp 11 thus allowing the lower jaw 4 to open to the position shown in which the spanner can be freely turned around a hexagon bolt head or nut 20.

Figure 2:
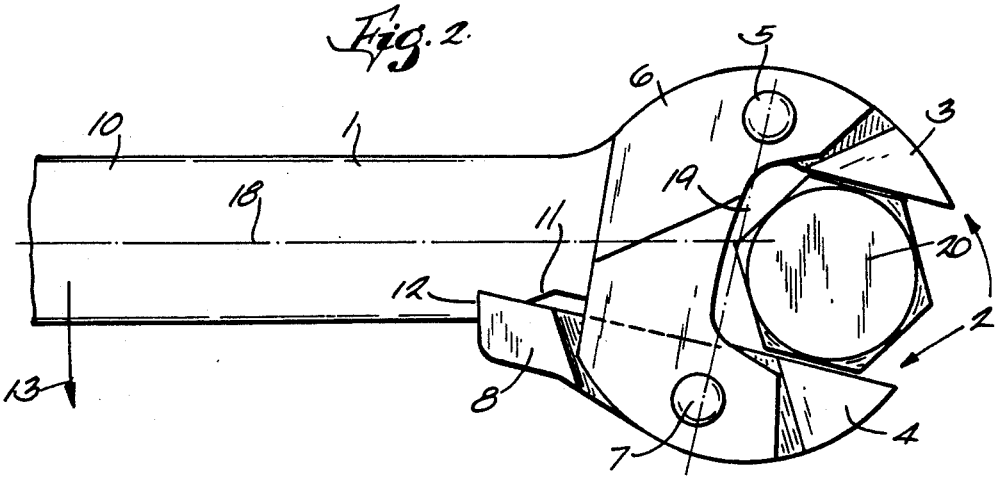
FIG. 2 is a view of the same spanner with the jaws in a closed position around a hexagon bolt head or nut.

Another distinguishing characteristic of this invention is that as shown in FIG. 2, a line 19 joining the centres of the upper hinge pin 5 and lower hinge pin 7 is nearly orthogonal to a longitudinal centre line 18 of the handle 1 in an arrangement in which the pawl 8 interacts with the handle 1 at the ratchet tooth 9, a feature not found in prior art designs.

When the handle 1 is rotated in the direction indicated by the arrow 13 in FIG. 2 (counter-clockwise in this view for the purpose of unscrewing a bolt head or nut, for example) the rotation of the handle 1 with respect to the upper jaw 3 causes the pawl 8 to ride up the ramp 11 and into engagement with the stop 12 thereby closing the jaws to a predetermined gap between the jaws limited by the positive action of the stop 12. As can be seen this allows a small clearance between the jaws and the bolt head or nut 20 allowing the spanner to be slipped over the bolt head or nut 20 much as a conventional spanner.

Alternate repetition of the movements 12 and 13 shown in FIGS. 1 and 2 respectively provides the ratchet action for this open ended spanner.

The views of FIGS. 3 to 5 give greater clarity as to the construction of the components of the spanner and it may be mentioned that these views show the spanner "upside down" as compared with its orientation shown in FIGS. 1 and 2. The assembled spanner in this orientation would be appropriate for tightening a bolt head or nut rather than loosening it as shown in FIGS. 1 and 2 assuming conventional right hand screw threads. Holes 14 in the handle 1 and 15 in the upper jaw 3 receive the upper hinge pin 5 and holes 16 in the upper jaw 3 and 17 in the lower jaw 4 receive the lower hinge pin 7.

FIGS. 3 to 5 also show that the distal part 6 of the handle 1 is arranged as two lobes of a clevis construction 20 and the part 21 of the upper jaw 3 where the hole 16 accommodated the lower hinge pin 7 is also in two lobes as a clevis construction. Part 22 of the upper jaw 3 is narrower to be accommodated between the lobes of the clevis 20 of the distal part 6 of the handle. Part 23 is narrower to be accommodated between the lobes of the clevis part 21 of the upper jaw 3.

I claim:

1. A spanner which comprises a handle and jaws, the jaws comprising an upper jaw and a lower jaw, the upper jaw being articulated by means of an upper hinge pin to a distal part of the handle and the lower jaw being articulated by means of a lower hinge pin to the upper jaw and in an opposed relation to the upper jaw for defining a gap therebetween for gripping a member, the lower jaw being extended by a pawl projecting on the opposite side of the lower hinge pin to the lower jaw, the handle comprising a ratchet tooth which engages with the pawl, the upper hinge pin being located near the distal end of the handle and the ratchet tooth being located at an intermediate position between the upper hinge pin and the proximal part of the handle, said ratchet tooth comprising a ramp and a stop, said ratchet tooth being constructed and arranged so that pivoting of the handle in a first direction with respect to the upper jaw causes the pawl to ride up the ramp thereby pivoting said lower jaw toward said upper jaw to close said gap until the pawl engages the stop which positively stops further closing of the jaws at a predetermined gap, pivoting said handle in an opposite direction causing said pawl to move down said ramp, thereby pivoting said lower jaw away from the upper jaw.

2. A spanner as claimed in claim 1 in which a line joining the centres of the upper and lower hinge pins is nearly orthogonal to the longitudinal axis of the handle.

3. The spanner as claimed in claim 1 wherein a line joining the first and second hinge axes is nearly orthogonal to the longitudinal axis of the handle.

4. A spanner having a handle, a first jaw pivotally mounted about a first hinge axis on a distal part of the handle, a member pivotally mounted on the first jaw about a second hinge axis, said member having a second jaw adjacent one end thereof and in an opposed relation to the first jaw for defining a gap therebetween whereby a member may be gripped therein, said second member also including a pawl projecting from the opposite end thereof, said handle including ratchet means formed thereon and positioned to be engaged by the pawl, said first axis being located near the distal end of the handle and the ratchet means being located at an intermediate position between the first hinge axis and the proximal part of the handle, said ratchet means including an inclined surface portion and a stop portion, said ratchet means being constructed and arranged so that rotation of the handle in a first direction with respect to the first jaw causes the pawl to move over said surface portion in one direction for rotating said second jaw toward said first jaw for gripping a member until the pawl engages the stop which prevents further closing of the jaws at a predetermined gap, rotation of said handle in the opposite direction moving said pawl over said surface in a second direction for opening said jaws to release said member.

5. The spanner as claimed in claim 4 wherein said surface is inclined outwardly relative to said hand to define a ramp.

* * * * *